US006086731A

United States Patent [19]

Ishigami et al.

[11] Patent Number: 6,086,731

[45] Date of Patent: Jul. 11, 2000

[54] COMPOSITE PLATING APPARATUS

[75] Inventors: Osamu Ishigami; Yoshimitsu Ogawa; Makoto Ishikawa, all of Sayama, Japan

[73] Assignee: Honda Giken Kogyo Kabushiki Kaisha, Tokyo, Japan

[21] Appl. No.: 08/953,131

[22] Filed: Oct. 17, 1997

[30] Foreign Application Priority Data

Oct. 24, 1996 [JP] Japan ..... 8-282639
Nov. 5, 1996 [JP] Japan ..... 8-292603

[51] Int. Cl.[7] ..... C25D 7/04; C25D 17/00; C25D 17/12

[52] U.S. Cl. ..... 204/224 R; 204/272; 204/284; 204/237

[58] Field of Search ..... 204/237, 272, 204/284, 224 R

[56] References Cited

U.S. PATENT DOCUMENTS

| | | | |
|---|---|---|---|
| 3,706,646 | 12/1972 | Gibson, Jr. et al. . | |
| 4,085,010 | 4/1978 | Ishimori et al. . | |
| 4,183,799 | 1/1980 | Sellitto et al. . | |
| 4,199,414 | 4/1980 | Shum . | |
| 4,304,641 | 12/1981 | Grandia et al. . | |
| 4,498,967 | 2/1985 | Paulet et al. | 204/272 |
| 4,645,580 | 2/1987 | Paulet et al. | 204/272 |
| 4,929,327 | 5/1990 | Mielsch | 204/272 |
| 5,266,181 | 11/1993 | Matsumura et al. . | |
| 5,516,417 | 5/1996 | Kondou et al. | 204/272 X |
| 5,540,829 | 7/1996 | Mase et al. . | |
| 5,620,575 | 4/1997 | Karasawa et al. . | |

FOREIGN PATENT DOCUMENTS

| | | |
|---|---|---|
| 7-118891 | 5/1995 | Japan . |
| 1 200 410 | 7/1970 | United Kingdom . |

OTHER PUBLICATIONS

WPI Accession No. 94–141295/17 & JP 6088284 A (Abstract) No Date.
WPI Accession No. 93–089093/11 & JP 5033186 A (Abstract) No Date.
WPI Accession No. 90–088558/12 & JP 2043399 A (Abstract) No Date.
Communication from UK Patent Office and attached Search Report No Date.

*Primary Examiner*—Donald R. Valentine
*Attorney, Agent, or Firm*—Merchant & Gould P.C.

[57] ABSTRACT

A composite plating apparatus includes a cylindrical electrode which is positioned in a hollow section of a workpiece with a surrounding gap left therebetween. A plurality of through-holes are formed across the thickness of an outer wall of the cylindrical electrode. Composite plating liquid is jetted out through the through-holes and impinge on the inner surface of the hollow section to thereby produce turbulence. The turbulent liquid provides a uniform distribution of ceramic particles in the liquid. As a result, the ceramic particles can be co-deposited uniformly in a metallic matrix, and hence a uniform abrasion-resistant characteristic is obtained all over a resultant composite plating film.

9 Claims, 17 Drawing Sheets

S1
S2
2
12
11
1
3
4
10
26
8
9
6
18
17
16
20
19
7
15
5
13
14
P

COMPOSITE PLATING APPARATUS

BACKGROUND OF THE INVENTION

1. Field of the Invention

The present invention relates to composite plating apparatuses which form a composite plating film on the inner surface of a hollow section in a workpiece such as a cylinder block of an engine.

2. Description of the Related Art

Among various examples of the conventionally-known cylinder blocks of internal combustion engine are one where the inner surface of each cylinder, functioning as a sliding surface for a piston, is die-cast integrally with the cylinder block and provided with a composite plating film of Ni (nickel) and SiC (silicon carbide). The Ni/SiC composite plating film is formed by co-depositing SiC in a metal-phase Ni matrix and acts to enhance an abrasion-resistant characteristic of the cylinder inner surface.

Japanese Patent Laid-open Publication No. HEI-7-118891 discloses a surface processing apparatus performing a high-speed plating process, in accordance with which a composite plating film can be formed on the inner surface of a cylinder at an increased speed by compulsorily passing composite plating liquid along the cylinder inner surface. FIG. 18 hereof shows a Ni/SiC composite plating process performed by the disclosed surface processing apparatus.

According to the process of FIG. 18, a cylindrical electrode 102 is provided in a cylinder opening 101 of a cylinder block 100 with a surrounding gap S so that the gap S forms an annular passage 104 between the outer surface of the electrode 102 and the inner surface of the cylinder. The composite plating liquid is caused to first flow in an upward direction as denoted by arrow (1) and then turn inwardly around the top of the electrode 102 to flow in a downward direction as denoted by arrow (2). By energizing the electrode 102 and cylinder block 100 while continuing the flow of the composite plating liquid in the directions of arrow (1) and arrow of (2), a multiplicity of SiC particles 106 are co-deposited in a Ni matrix 105 to provide composite plating film 107.

However, the composite plating film 107 has a drawback as shown in FIG. 19. Namely, because the composite plating liquid flows in the arrowed upward direction along the annular passage 104, a great number of the SiC particles 106 are undesirably co-deposited in an upstream (lower in the figure) portion of the Ni matrix 105. Thus, as the composite plating liquid flows upward (downstream), the number of the SiC particles 106 in the liquid would significantly decrease and the amount of the co-deposited SiC particles 106 in the liquid would gradually decrease. This would present the inconvenience that the resultant composite plating film presents a low abrasion-resistant characteristic in the downstream portion of the cylinder.

SUMMARY OF THE INVENTION

According to a first aspect of the present invention, there is provided a composite plating apparatus for forming a composite plating film on the inner surface of a hollow section of a workpiece which comprises: a cylindrical electrode disposed in the hollow section of the workpiece with a surrounding gap left between a surface of an outer wall of the cylindrical electrode and the inner surface of the hollow section, the cylindrical electrode being closed at one of upper and lower ends thereof and having a plurality of through-holes formed across a thickness of the outer wall facing the inner surface of the hollow section; a plating liquid circulating mechanism for supplying composite plating liquid, consisting of ceramic particles mixed in plating liquid, to the interior of the cylindrical electrode, causing the composite plating liquid to be jetted through the through-holes of the outer wall onto the inner surface of the hollow section, and collecting the jetted composite plating liquid from a region surrounding the cylindrical electrode; and a power supply for energizing the workpiece and the cylindrical electrode.

The composite plating liquid is jetted out of the cylindrical electrode through the through-holes and impinge on the inner surface of the hollow section section, to thereby produce turbulence. The turbulent liquid provides a uniform distribution of ceramic particles in the liquid. As a result, the ceramic particles can be co-deposited uniformly in a metallic matrix, and hence a uniform abrasion-resistant characteristic is obtained all over a resultant composite plating film.

Normally, the composite plating liquid supplied to the interior of the cylindrical electrode and flowing downstream is blocked by the lid portion, so that the liquid pressure near the lid portion would significantly increase. However, by choosing the diameters of the through-holes to become progressively smaller as the through-holes are located closer to the downstream end of the cylindrical electrode, the composite plating liquid can be jetted out through all the through-holes in practically uniform amounts. Thus, the ceramic particles are allowed to impinge on the inner surface of the hollow section in a uniform condition, so that the ceramic particles can be co-deposited uniformly in a metallic matrix.

Preferably, the through-holes are formed at a uniform pitch in the outer wall of the cylindrical electrode in such a manner to provide vertical and horizontal arrangements of the through-holes. In this case, the composite plating liquid is jetted out through the through-holes at equal intervals, so that the ceramic particles are allowed to impinge on the inner surface of the hollow section in a uniform condition and the ceramic particles can be co-deposited uniformly in the metallic matrix.

In another preferred implementation, the through-holes are formed in the outer wall of the cylindrical electrode to provide vertical and horizontal arrangements of the through-holes, and every adjacent ones of the arrangements forms a staggering or zigzag series of the through-holes. In this case, the through-holes can be arranged densely in the circumferential direction of the outer wall. The dense arrangement of the through-holes allows the ceramic particles to impinge on the inner surface of the hollow section in a dense condition, thereby providing a dense co-deposition of the ceramic particles in the metal matrix.

In another preferred implementation, each of the through-holes tapers, across the thickness of the outer wall, toward the interior of the cylindrical electrode. In this case, the composite plating liquid can be jetted out through the through-holes in a spread condition. The spreading allows the composite plating liquid, jetted through the through-holes, to efficiently impinge on a wider area of the inner surface of the hollow section, so that the ceramic particles can be co-deposited in the metal matrix in a uniformly distributed condition.

In yet another preferred implementation, the cylindrical electrode has an inner diameter that becomes progressively greater or smaller from the other end to the closed one end. In this case, the composite plating liquid introduced in the cylindrical electrode produces turbulence here and there within the electrode, so that the ceramic particles can be distributed uniformly in the liquid. As a result, the ceramic particles jetted through the through-holes can be co-deposited uniformly in the metal matrix laminated on the inner surface of the hollow section.

In one implementation, all of the through-holes tapers are may be a cylindrical hole and have a same diameter.

BRIEF DESCRIPTION OF THE DRAWINGS

Preferred embodiments of the present invention will be described hereinbelow, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

Figure 1:
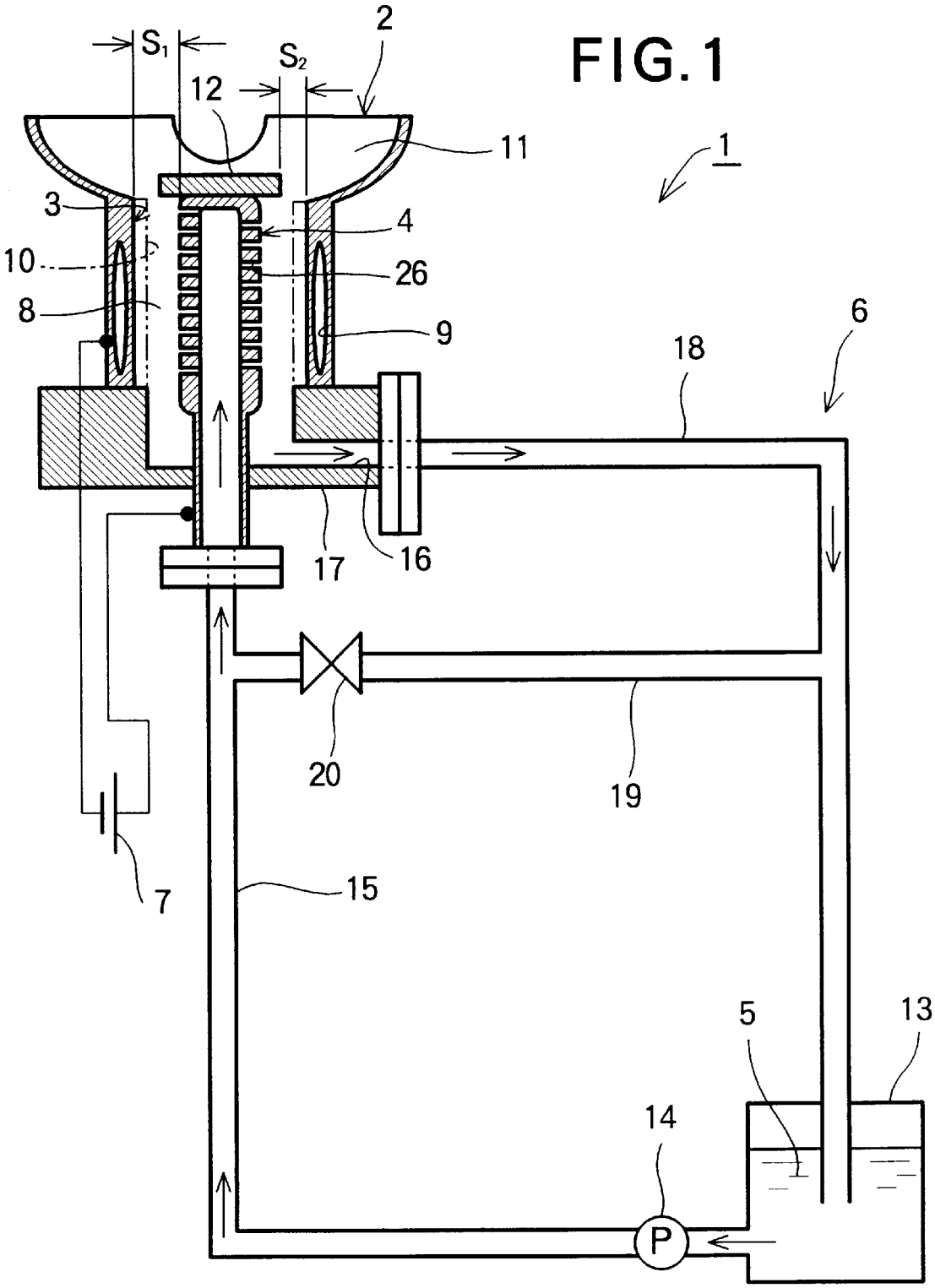
FIG. 1 is a schematic view illustrating an overall setup of a composite plating apparatus according to a preferred embodiment of the present invention.

FIG. 1 is a schematic view illustrating an overall setup of a composite plating apparatus according to a preferred embodiment of the present invention. In FIG. 1, the composite plating apparatus 1 comprises: a cylindrical electrode 4 provided within a hollow section or cylinder 3 of a workpiece—in this example, a cylinder block 2 of an internal combustion engine—with a surrounding gap $S_1$ left between the surface of an outer wall of the electrode 4 and the inner surface of the hollow section 3; a plating liquid circulating mechanism 6 for passing later-described composite plating liquid 5 through an interior flow passage of the cylindrical electrode 4; and a power supply 7 for energizing the cylinder block 2 and cylindrical electrode 4. The cylindrical electrode 4 will be later described in detail in relation to FIG. 2.

Reference numeral 8 denotes an annular passage defined by the inner surface of the hollow section 3 and the cylindrical electrode 4, and 9 denotes a water jacket functioning as a circulating channel for coolant. Reference numeral 10 denotes the cylinder inner surface, 11 denotes a crankcase, and 12 denotes a barrier plate made of a resilient material which has a diameter smaller than the inner diameter of the hollow section 3 so that the gap $S_1$ is limited to a narrower gap $S_2$ between the outer edge of the plate 12 and the inner surface of the hollow section 3.

The plating liquid circulating mechanism 6 includes: a tank 13 containing the composite plating liquid 5; a pump 14 communicating with an outlet of the tank 13; a feed pipe 15 for connecting an outlet of the pump 14 to an inlet of the cylindrical electrode 4; a base table 17 on which the cylinder block 2 is placed and which has a return path 16 formed therein in communication with the annular passage 8; and a drain pipe 18 connecting the return path 16 to the tank 13.

Further, reference numeral 19 denotes a relief pipe connected between the feed pipe 15 and the drain pipe 18, and 20 denotes a relief valve provided in the relief pipe 19. When the internal pressure within the feed pipe 15 exceeds a predetermined value, the relief valve 20 opens to allow the internal pressure to escape to the drain pipe 18, so as to prevent the internal pressure within the cylindrical electrode 4 from becoming excessive.

In this embodiment, the composite plating liquid 5 consists of 60 g of silicon carbide (SiC) suspended in one liter of water, whose hardness is previously adjusted to pH 4 by adding thereto 400 g of nickel sulfate ($NiSO_4$), 35 g of boric acid and 2.5 g of sodium saccharin.

Figure 2:
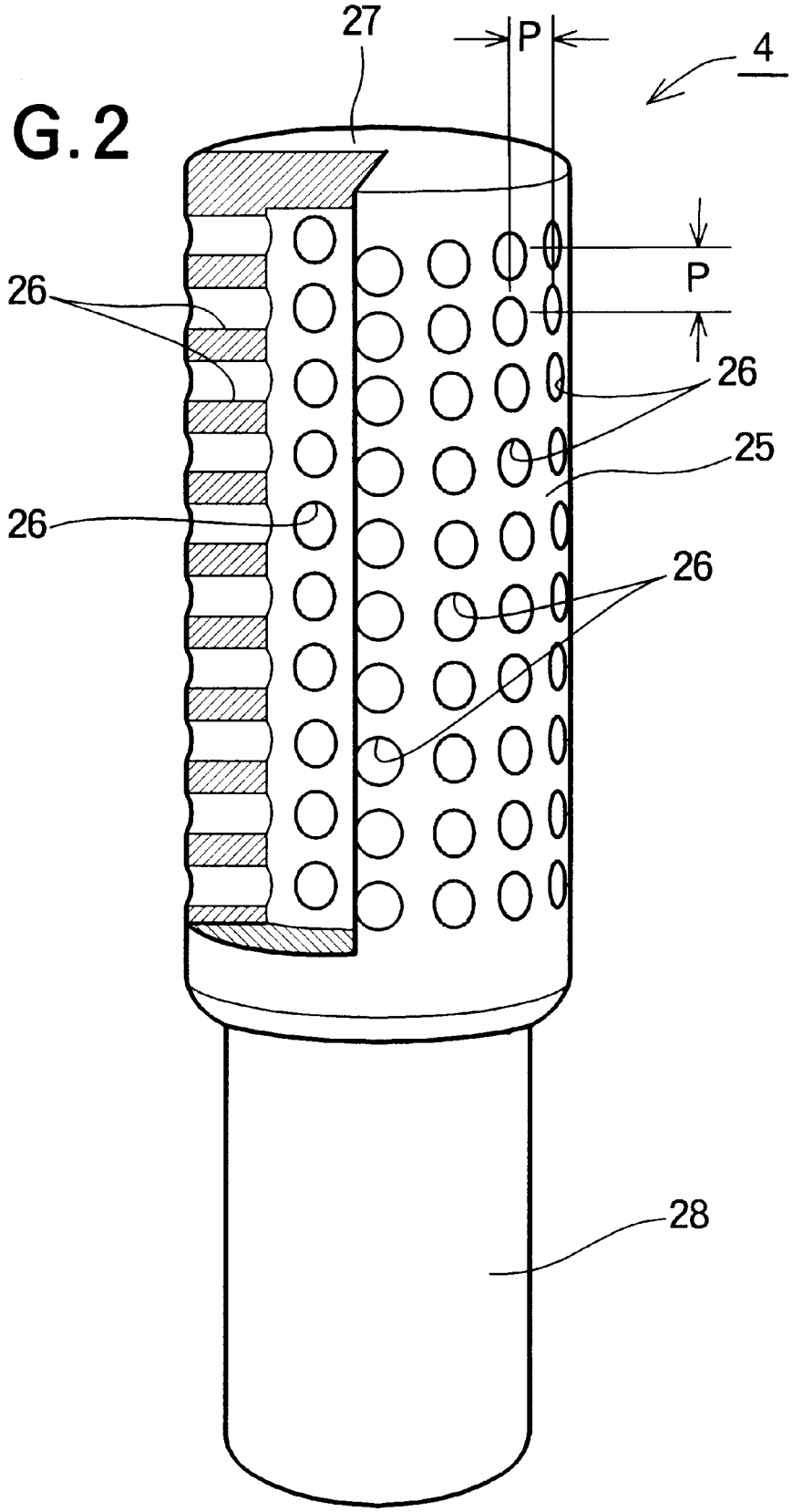
FIG. 2 is an enlarged fragmentary perspective view, partly in section, of a cylindrical electrode shown in FIG. 1.

FIG. 2 is an enlarged fragmentary perspective view, partly in section, of the cylindrical electrode 4 shown in FIG. 1. The cylindrical electrode 4 is, for example, made of a copper (Cu) alloy material or of another metal material coated with titanium (Ti). The cylindrical electrode 4 includes: an outer wall 25 facing the inner surface of the hollow section 3 of FIG. 1; a multiplicity of through-holes 26 formed at a uniform pitch P in the outer wall 25 in vertical and horizontal arrangements; a lid portion 27 provided at the top of the outer wall 25 for mounting thereon the barrier plate 12; and a neck portion 28 extending downward from the bottom of the wall 25. The outer wall 25 is greater in diameter than the neck portion 28.

Figure 3:
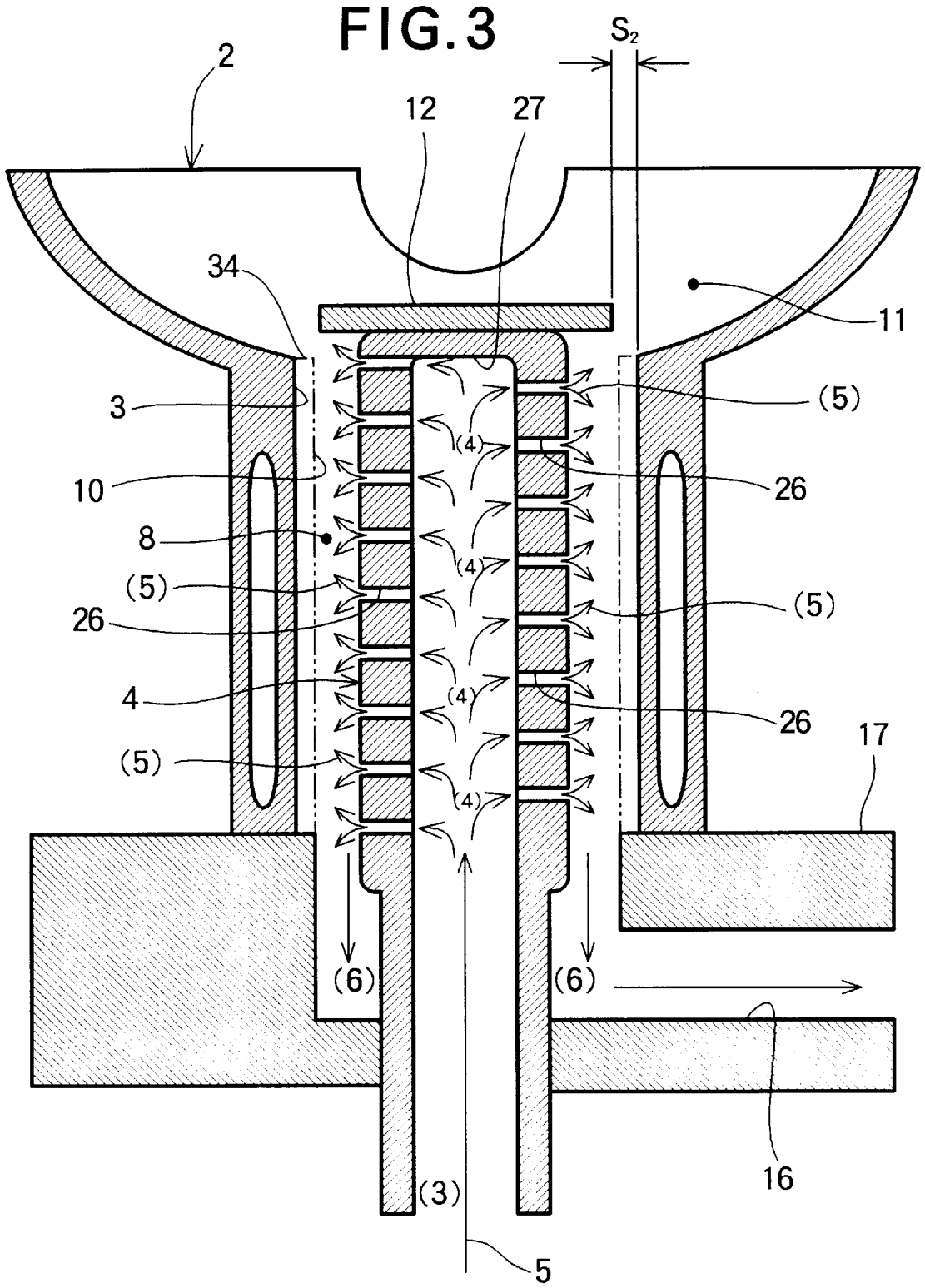
FIG. 3 is a view showing a manner in which composite plating liquid flows in the composite plating apparatus shown in FIG. 1.

FIG. 3 shows a manner in which the composite plating liquid 5 flows within the cylinder block 2. The cylinder block 2 is placed, from above, on the base table 17 around the cylindrical electrode 4 in such a manner that the return path 16 in the table 17 communicates with the annular passage 8. In thus placing the cylinder block 2 on the base table 17, the gap $S_2$ between the outer edge of the barrier plate 12 and the inner surface of the hollow section 3 prevents the inner surface of the hollow section 3 from interfering with the barrier plate 12 provided at the top of the electrode 4. After the cylinder block 2 is thus placed in position, the pump 14 is actuated to feed the composite plating liquid 5 from the tank 13 to the interior of the cylindrical electrode 4 via the feed pipe 15, and the liquid 5 is caused to flow initially in the direction of arrow (3).

Then, the composite plating liquid 5 is blocked by the lid portion 27 provided at the downstream (upper in the figure) end of the cylindrical electrode 4 so that the liquid 5 is deflected in the direction of arrow (4) to flow into the through-holes 26, from which the liquid 5 is jetted out to the annular passage 8 as denoted by arrow (5) and impinges on the inner surface of the hollow section 3. Due to the impingement, the composite plating liquid 5 is caused to flow downward along the inner surface of the hollow section 3 as denoted by arrow (6), after which the liquid 5 passes through the return path 16 back into the tank 13 by way of the drain pipe 18 of FIG. 1. The barrier plate 12 functions to prevent the composite plating liquid 5 from entering the crankcase 11.

Figure 4:
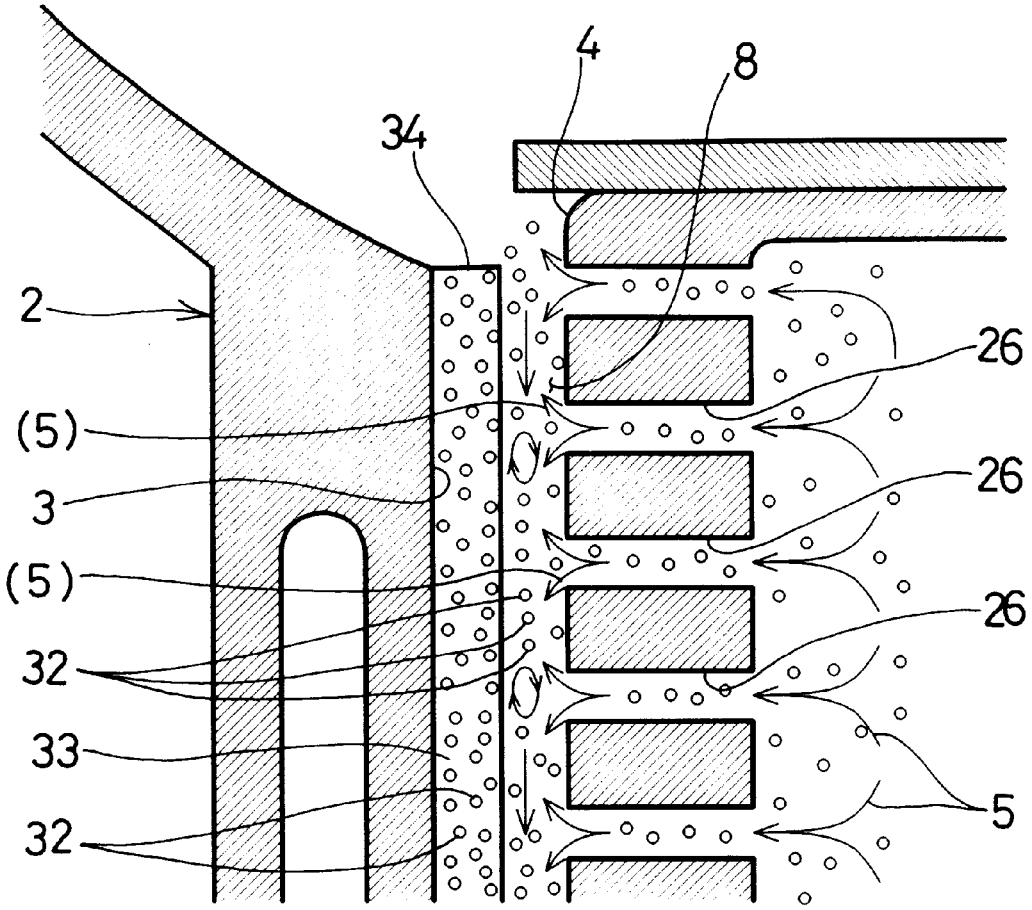
FIG. 4 is a view showing in greater detail the manner in which the composite plating liquid flows in the composite plating apparatus.

FIG. 4 shows in greater detail the manner in which the composite plating liquid 5 flows in the apparatus. Because the composite plating liquid 5, having passed through the through-holes 26 to the annular passage 8 as denoted by arrow (5), impinges on the inner surface of the hollow section 3 as noted earlier, the liquid 5 produces turbulence here and there in the annular passage 8 as denoted by looped arrows. Owing to the liquid turbulence, the SiC ceramic particles 32 can be distributed practically uniformly in the composite plating liquid 5 within the annular passage 8.

Under such conditions, the power supply 7 of FIG. 1 is turned on to energize the cylindrical electrode 4 and cylinder block 2, so that Ni ions in the composite plating liquid 5 are deposited on the inner surface of the hollow section 3 and the SiC particles 32 are co-deposited in the Ni matrix 33. Because the SiC particles 32 are distributed practically uniformly in the composite plating liquid 5, the SiC particles 32 can also be co-deposited uniformly in the Ni matrix 33.

Figure 5:
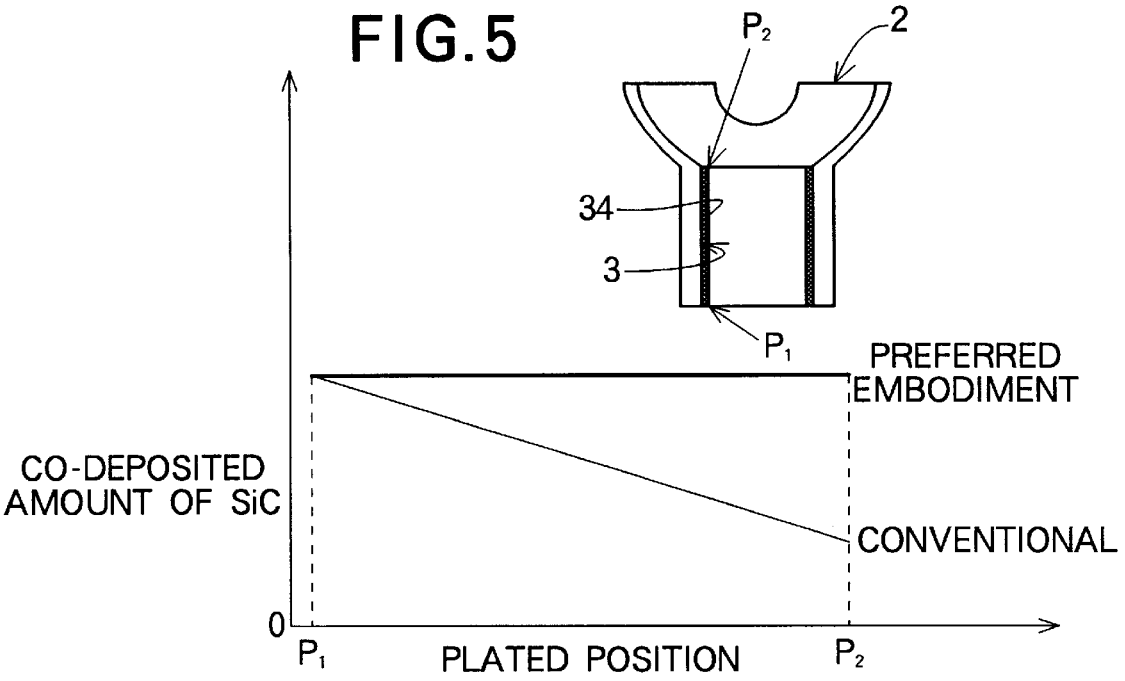
FIG. 5 is a graph comparing co-deposited amounts of SiC particles at various plated positions by the composite plating apparatus according to the preferred embodiment of the invention and by a conventional composite plating apparatus.

FIG. 5 is a graph comparatively showing the composite plating apparatus according to the preferred embodiment and a conventional composite plating apparatus. In FIG. 5, the horizontal axis represents plated positions between an end $P_1$ of the hollow section 3 close to a cylinder head (hereinafter referred to as a "cylinder-head-side end") and another end $P_2$ of the hollow section 3 close to the crankcase (hereinafter referred to as a "crankcase-side end"), while the vertical axis represents co-deposited amounts of the SiC particles in the resultant Ni/SiC composite plating film. Further, the heavy line is a plot relating to the Ni/SiC composite plating film 34 formed by the preferred embodiment, while the light line is a plot relating to the Ni/SiC composite plating film formed by the conventional composite plating apparatus.

From the graph, it is seen that the preferred embodiment of the present invention can provide substantially uniform co-deposited amounts of the SiC particles 32 in the resultant Ni/SiC composite plating film 34 throughout a region from the cylinder-head-side end $P_1$ to the crankcase-side end $P_2$. With the conventional composite plating apparatus, however, the co-deposited amount of the SiC particles becomes gradually smaller in a direction from the cylinder-head-side end $P_1$ to the crankcase-side end $P_2$. Because of the uniform co-deposited amount of the SiC particles 32 in the resultant Ni/SiC composite plating film 34, the preferred embodiment can uniformly enhance the abrasion-resistant characteristic of the hollow section 3.

Figure 6:
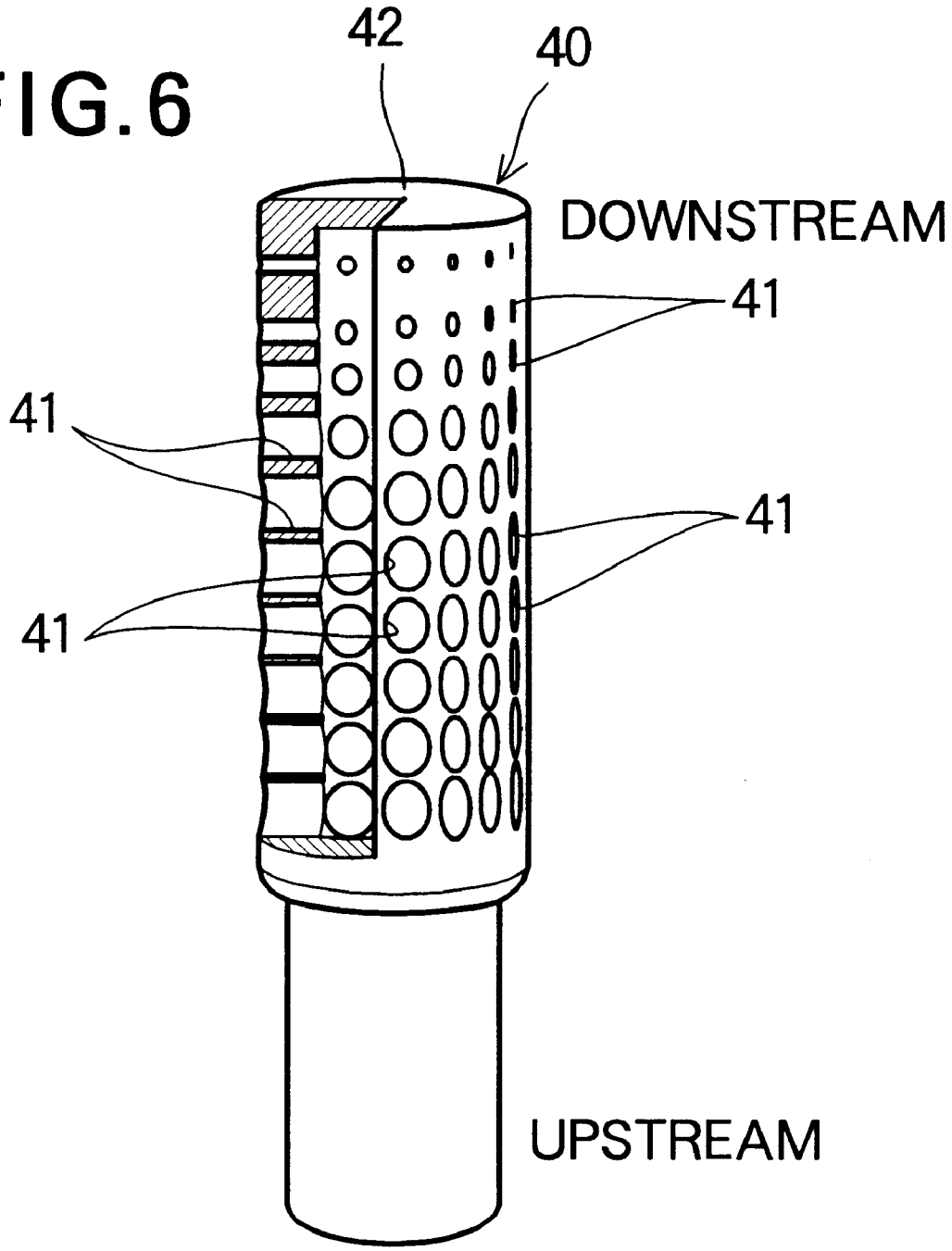
FIG. 6 is a partly-sectional perspective view showing a first modification of the cylindrical electrode shown in FIG. 1.

FIG. 6 is a perspective view showing a first modification of the cylindrical electrode. This first modified cylindrical electrode 40 of FIG. 6 is characterized in that the diameters of the through-holes 41 formed therein are chosen to become progressively smaller as the through-holes 41 are located closer to the downstream (upper in the figure) end, i.e., in the upstream-to-downstream direction (bottom-to-top direction in the figure).

Figure 7:
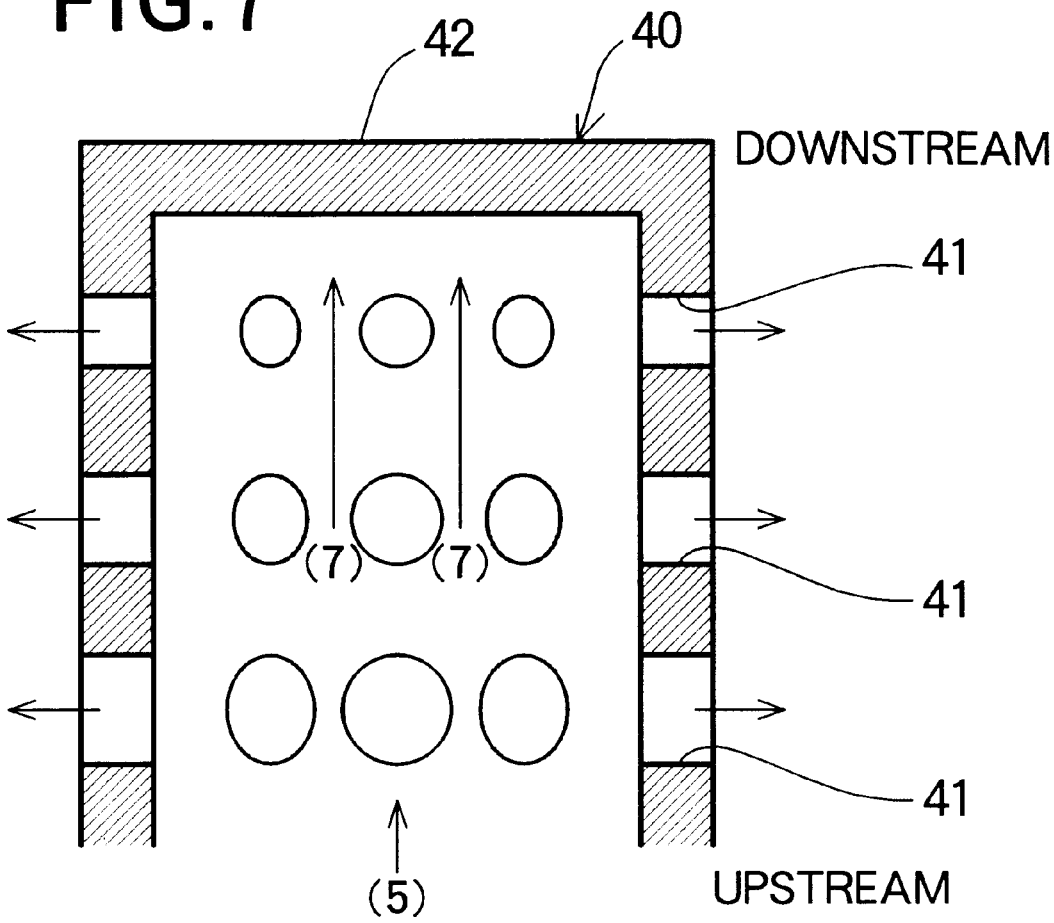
FIG. 7 is a view showing a manner in which the composite plating liquid flows through the modified cylindrical electrode of FIG. 6.

FIG. 7 shows a manner in which the composite plating liquid 5 flows through the modified cylindrical electrode 40 of FIG. 6. Normally, the composite plating liquid 5 supplied to the interior of the cylindrical electrode 40 and flowing downstream, i.e., in the direction of arrow (7), is blocked by the lid portion 42, so that the liquid pressure near the lid portion 42 would significantly increase. However, because the through-holes 41 located closer to the lid portion 42 under a higher liquid pressure are chosen to be smaller in diameter than the through-holes 41 closer to the upstream end of the electrode 40 under a lower liquid pressure, the modified cylindrical electrode 40 allows the composite plating liquid 5 to be jetted out through all the through-holes 41 in practically uniform amounts.

Figure 8:
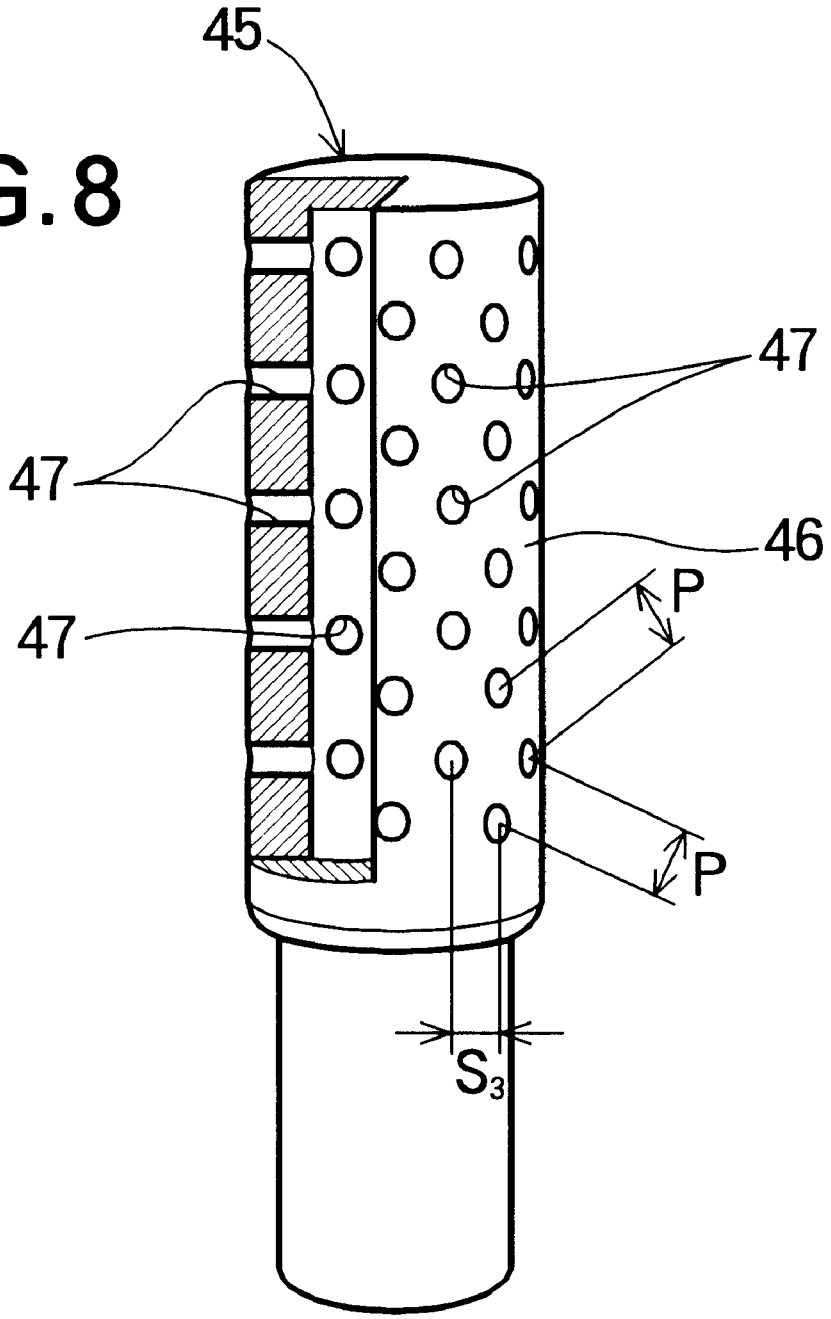
FIG. 8 is a partly-sectional perspective view showing a second modification of the cylindrical electrode.

FIG. 8 is a perspective view showing a second modification of the cylindrical electrode. This second modified cylindrical electrode 45 is characterized in that the through-holes 47 are formed in the outer wall 46 in vertical and horizontal arrangements, and every adjacent ones of the arrangements forming a "staggering" or "zigzag" series of the through-holes located at a uniform pitch P. The pitch $S_3$, as measured in the horizontal direction of the electrode 45, between every two obliquely-adjacent through-holes 47 is smaller than the pitch P between every two horizontally-adjacent through-holes 26 in the cylindrical electrode 4 of FIG. 2, and thus the through-holes 47 are arranged more densely in the circumferential direction of the outer wall. The dense arrangement of the through-holes 47 allows the SiC particles 32 to impinge on the inner surface of the hollow section 3 (FIG. 1) in a dense condition, thereby providing a dense co-deposition of the SiC particles 32 in the Ni matrix 33.

Figure 9:
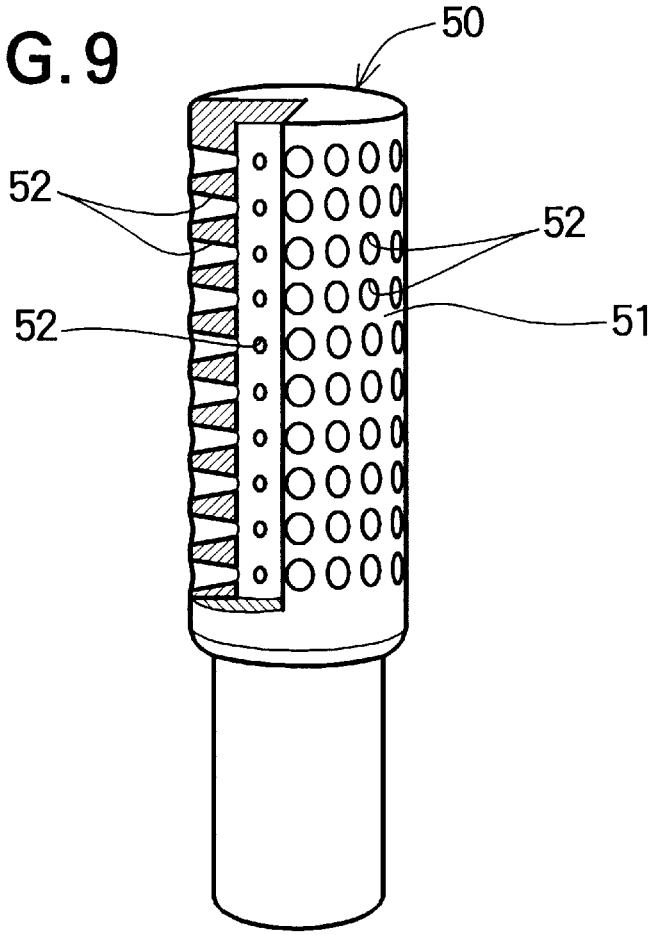
FIG. 9 is a partly-sectional perspective view showing a third modification of the cylindrical electrode.

FIG. 9 is a perspective view showing a third modification of the cylindrical electrode. This third modified cylindrical electrode 50 is characterized in that each of the through-holes 52 formed in the outer wall 51 tapers, across the thickness of the wall 51, toward the interior of the electrode 50 (i.e., each of the through-holes 52 widens toward the exterior of the electrode 50); that is, each of the through-holes 52 has a greatest diameter at the outer surface of the wall 51 and a smallest diameter at the inner surface of the wall 51.

Figure 10:
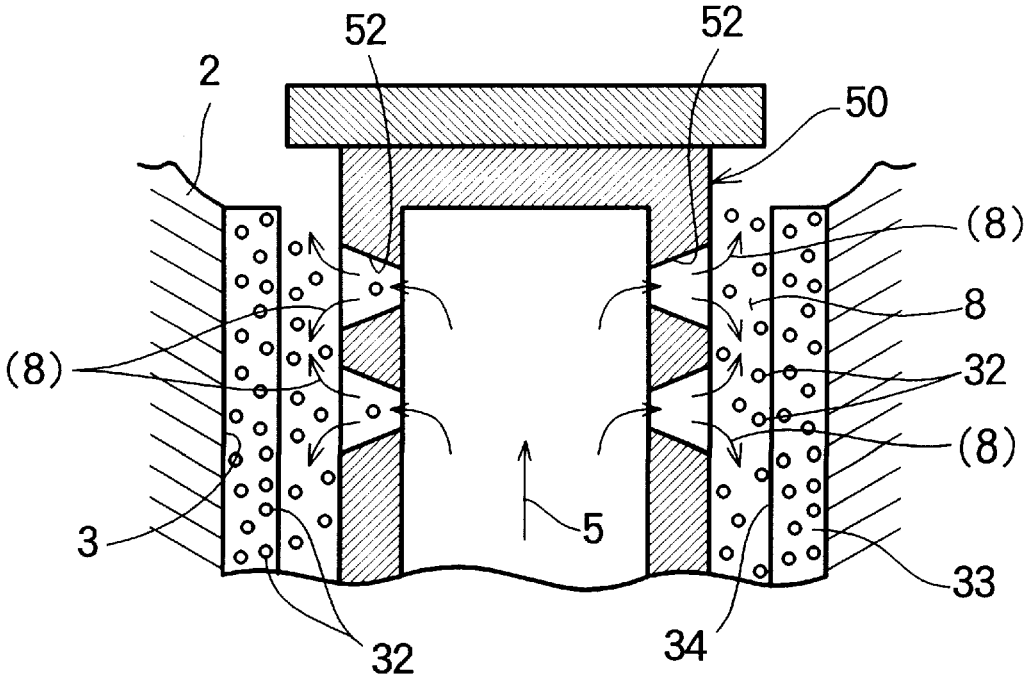
FIG. 10 is a view explanatory of a manner in which the composite plating liquid flows through the third modified cylindrical electrode of FIG. 9.

FIG. 10 is a view explanatory of a manner in which the composite plating liquid flows through the third modified cylindrical electrode 50. Because each of the through-holes 52 formed in the outer wall 51 tapers toward the interior of the electrode 50 as mentioned, the composite plating liquid 5 can be jetted out to the annular passage 8 while spreading in the direction of arrow (8). The spreading allows the composite plating liquid 5, jetted through the through-holes 52, to impinge on a wider area of the inner surface of the hollow section 3, so that the ceramic particles can be co-deposited in the Ni matrix in a uniformly distributed condition.

The essential feature of the composite plating apparatus so far described in relation to FIGS. 1 to 10 is that the cylindrical electrode 4, 40, 45 or 50 is positioned in the hollow section 3 of the workpiece with a surrounding gap $S_1$ left therebetween and that a plurality of through-holes are formed across the thickness of the electrode outer wall. Thus, by allowing the composite plating liquid 5 to be jetted out through the through-holes to impinge on the inner surface of the hollow section, the liquid 5 produces turbulence, which provides uniform distribution of the ceramic particles in the liquid. As a result, the SiC ceramic particles 32 can be co-deposited uniformly in the metallic matrix, and hence the resultant composite plating film can have a uniform abrasion-resistant characteristic.

Figure 11:
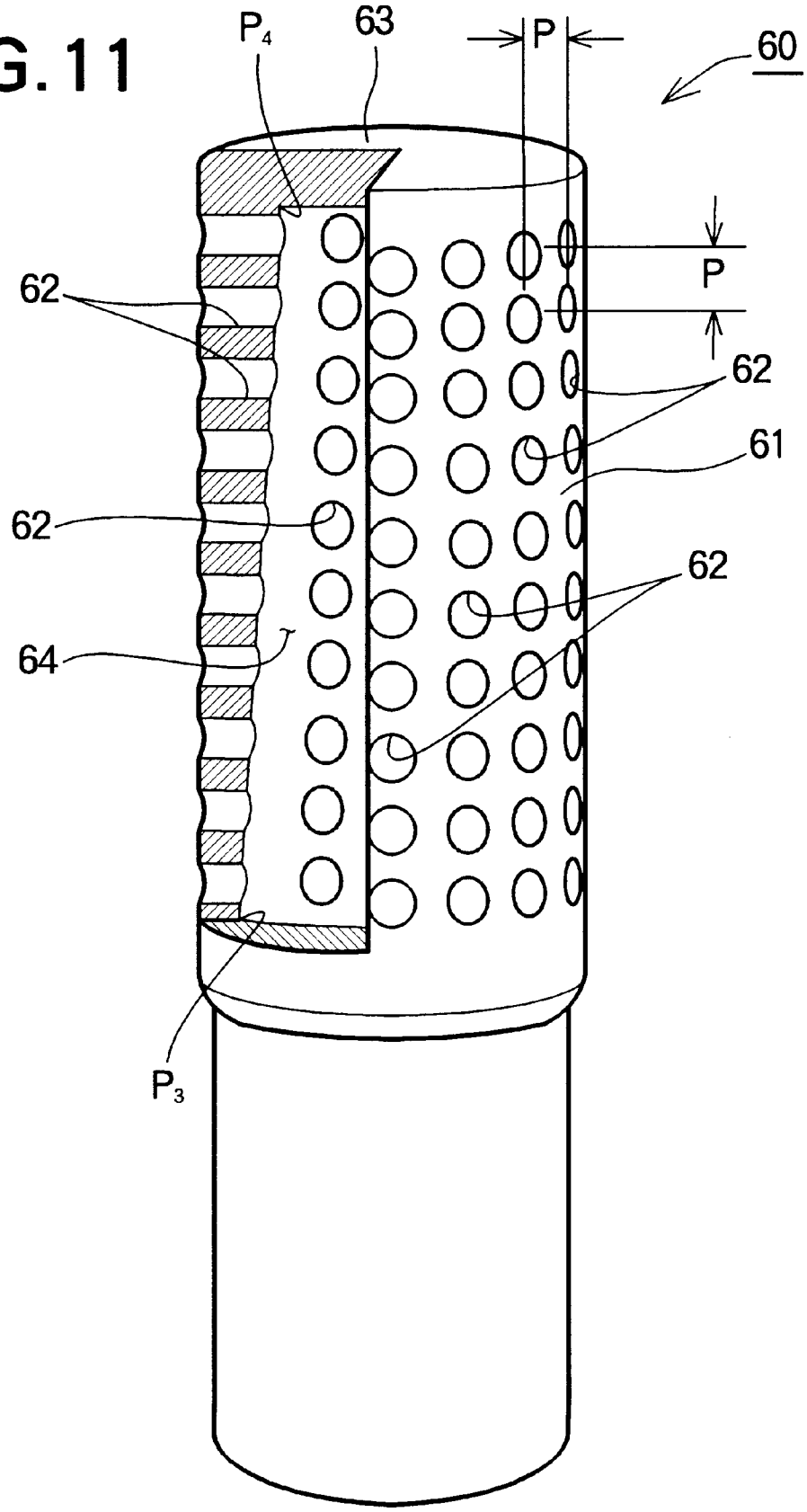
FIG. 11 is a perspective view, partly in section, of a fourth modification of the cylindrical electrode.

FIG. 11 is a perspective view, partly in section, of a fourth modification of the cylindrical electrode. This fourth modified cylindrical electrode 60 is characterized in that the outer wall 61 is formed to become progressively smaller in inner diameter in a direction from the upstream end or bottom $P_3$ to the downstream end or top $P_4$ so that the thickness of the outer wall 61 becomes gradually greater in the bottom-to-top direction of the electrode 60. Thus, the lengths of the through-holes 62 in the outer wall 61 become progressively greater as the through-holes 62 are located closer to the top of the electrode 60. The downstream end or top of the cylindrical electrode 60 is covered and closed with the fixed lid portion 63.

Figure 12:
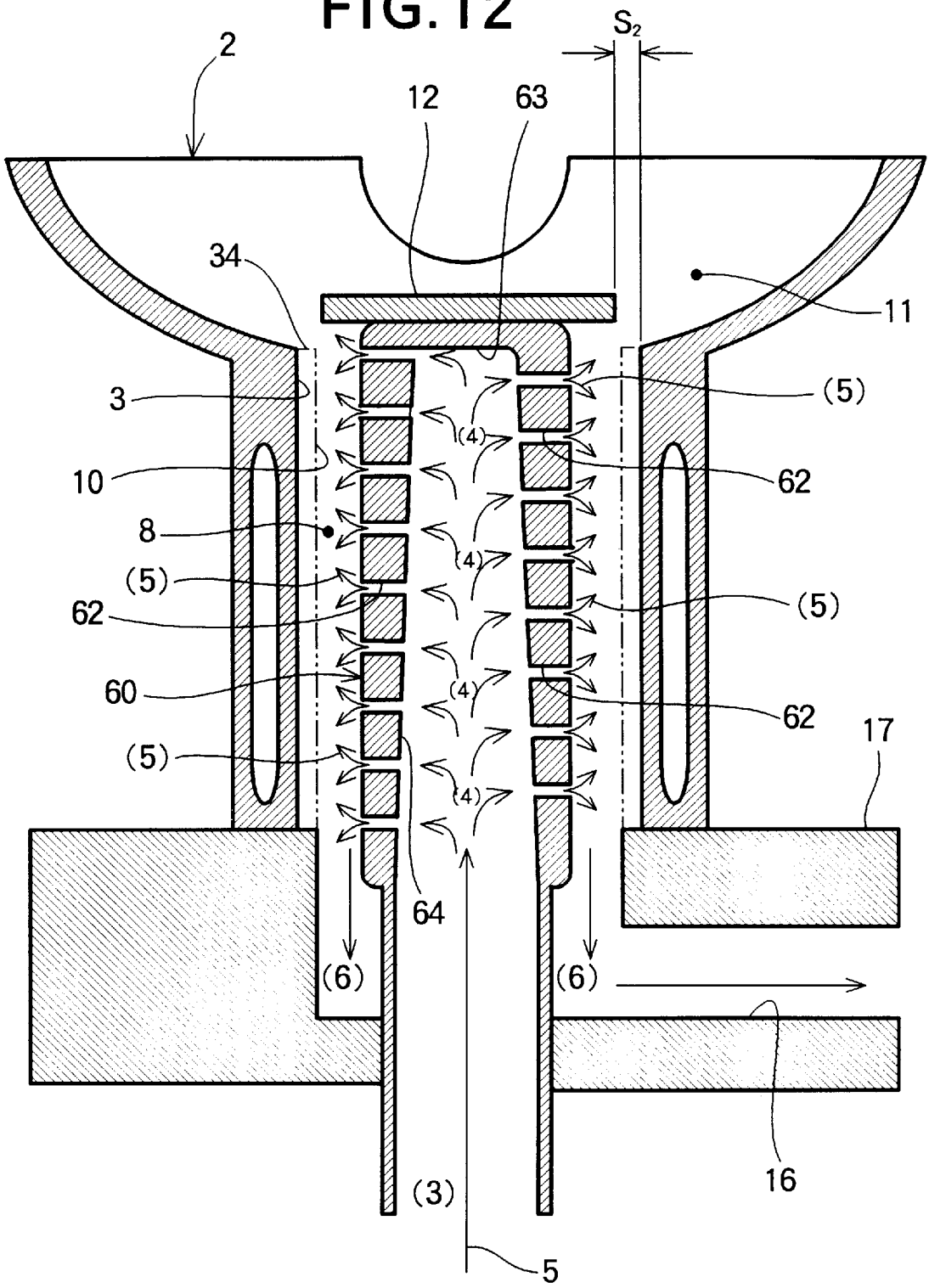
FIG. 12 is a view showing an overall flow of the composite plating liquid in the composite plating apparatus employing the fourth modified cylindrical electrode shown in FIG. 11.

FIG. 12 is a view showing an overall flow of the composite plating liquid 5 in the composite plating apparatus employing the fourth modified cylindrical electrode 60 shown in FIG. 11. As previously described in relation to FIG. 3, the cylinder block 2 is placed, from above, on the base table 17 around the cylindrical electrode 60 in such a manner that the return path 16 in the table 17 communicates with the annular passage 8. After the cylinder block 2 is thus placed in position, the pump 14 is actuated to feed the composite plating liquid 5 from the tank 13 to the interior of the cylindrical electrode 60 via the feed pipe 15, and the liquid 5 is caused to flow initially in the direction of arrow (3).

As with the above-described electrode 4, the composite plating liquid 5 is blocked by the lid portion 63 provided at the downstream (upper in the figure) end of the electrode 4 so that the liquid 5 is deflected in the direction of arrow (4) to flow through the through-holes 62, from which the liquid 5 is jetted out to the annular passage 8 as denoted by arrow (5) and impinges on the inner surface of the hollow section 3. Due to the impingement, the composite plating liquid 5 is caused to flow downward along the inner surface of the hollow section 3 as denoted by arrow (6), after which the liquid 5 passes through the return path 16 back into the tank 13 by way of the drain pipe 18.

Figure 13:
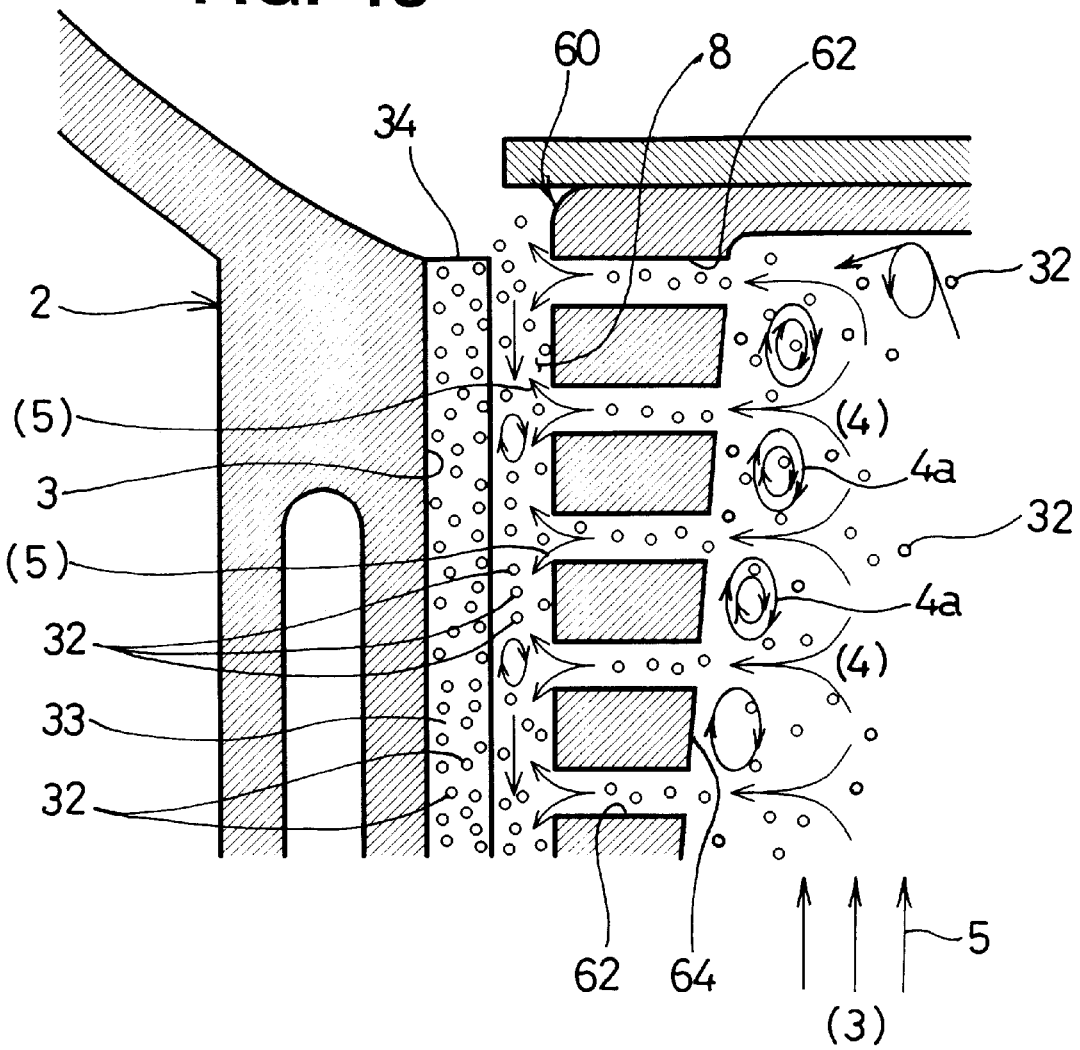
FIG. 13 is a partly sectional view showing in greater detail the flow of the composite plating liquid shown in FIG. 12.

FIG. 13 is a partly sectional view showing in greater detail the flow of the composite plating liquid 5 shown in FIG. 12. Because of the inner diameter of the cylindrical electrode 60 becoming progressively smaller in the bottom-to-top direction, the composite plating liquid 5 supplied in the direction of arrow (3) flows faster in its portion close to the inner surface 64 of the wall than in its central portion and thus produces turbulence as denoted by looped arrows 4a within the electrode 60. Due to the turbulence of the composite plating liquid 5, the SiC ceramic particles 32 can be distributed uniformly in the composite plating liquid 5 introduced in the cylindrical electrode 60.

The composite plating liquid 5 with the uniformly distributed SiC particles 32 passes through the through-holes 62 in the direction of arrow (4) and is then jetted out to the annular passage 8 in the direction of arrow (5). The jetted composite plating liquid 5 impinges on the inner surface of the hollow section 3 to again produce turbulence in the annular passage 8 as denoted by looped arrows. Owing to the turbulence, the SiC ceramic particles 32 can be distributed uniformly in the composite plating liquid 5 introduced in the annular passage 8.

Under such conditions, the power supply 7 of FIG. 1 is turned on to energize the cylindrical electrode 60 and cylinder block 2, so that Ni ions in the composite plating liquid 5 are deposited on the inner surface of the hollow section 3 and the SiC particles 32 are co-deposited in the Ni matrix 33. Because the SiC particles 32 are distributed practically uniformly in the composite plating liquid 5, the SiC particles 32 can also be co-deposited uniformly in the Ni matrix 33.

Figure 14:
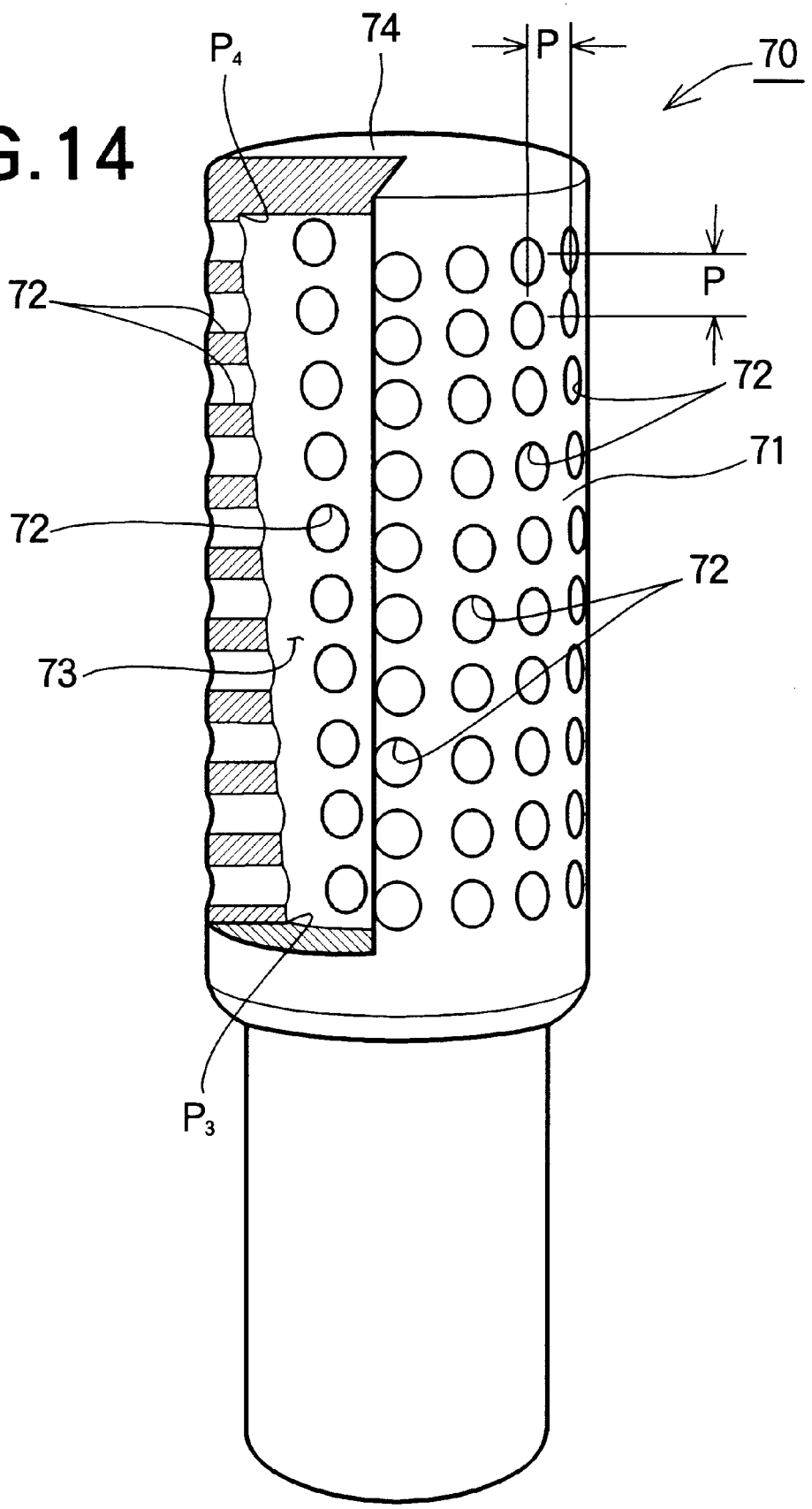
FIG. 14 is a perspective view, partly in section, of a fifth modification of the cylindrical electrode.

FIG. 14 is a perspective view, partly in section, of a fifth modification of the cylindrical electrode. This fifth modified cylindrical electrode 70 has its inner surface sloping oppositely to the inner surface 64 of the fourth modified cylindrical electrode 60 shown in FIG. 11; that is, the cylindrical electrode 70 is characterized in that the outer wall 71 is formed to become progressively greater in inner diameter in a direction from the upstream end or bottom $P_3$ to the downstream end or top $P_4$ so that the thickness of the outer wall 71 becomes gradually smaller in the bottom-to-top direction of the electrode 70. Thus, the lengths of the through-holes 72 in the outer wall 61 become progressively smaller as the through-holes 72 are located closer to the top of the electrode 70. The top of the cylindrical electrode 70 is covered and closed with the fixed lid portion 74.

Figure 15:
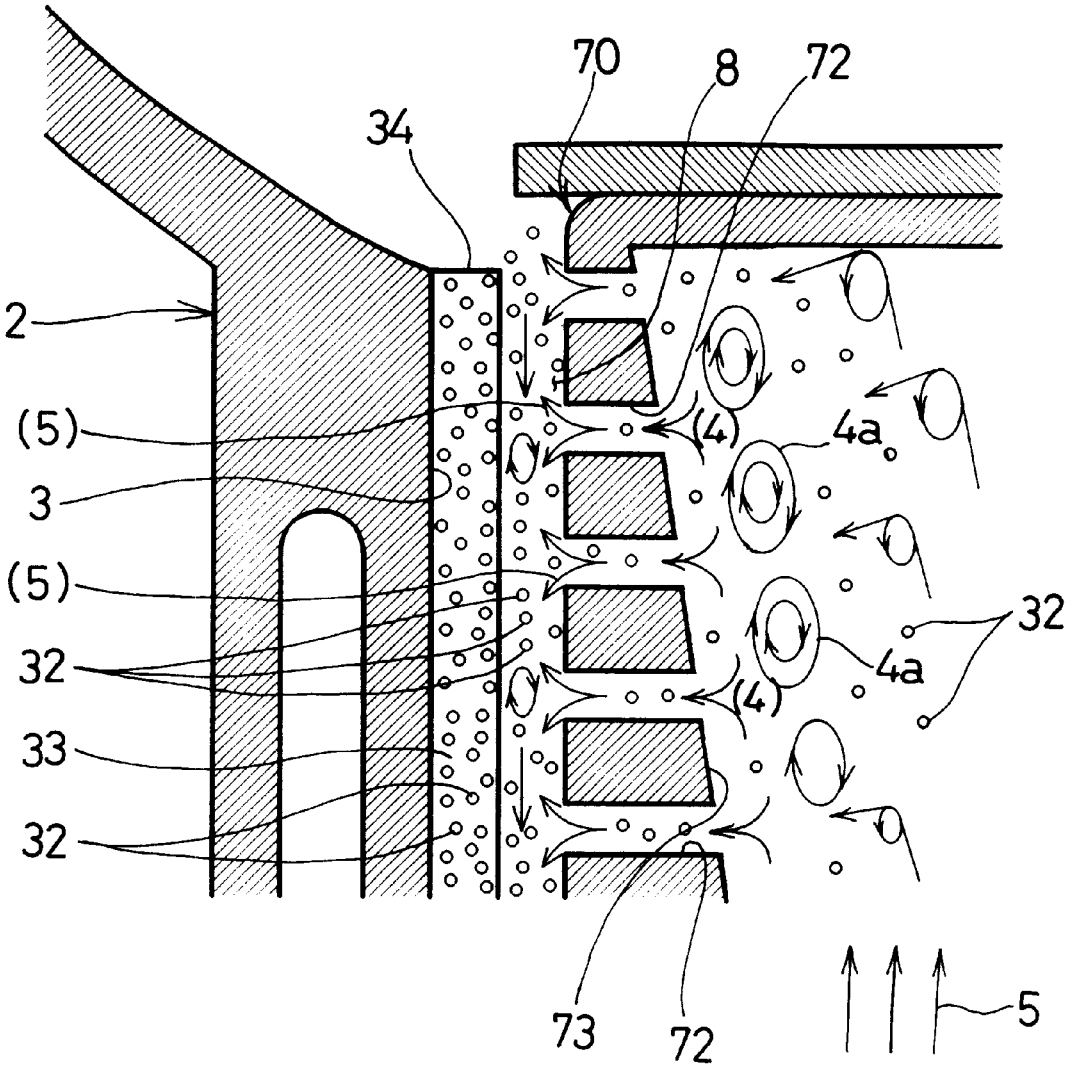
FIG. 15 is a view showing the flow of the composite plating liquid through the fifth modified cylindrical electrode shown in FIG. 14.

FIG. 15 is a fragmentary partly sectional view showing in greater detail the flow of the composite plating liquid 5 through the fifth modified cylindrical electrode 70 shown in FIG. 14. Because of the inner diameter of the cylindrical electrode 70 becoming progressively greater in the bottom-to-top direction, the composite plating liquid 5 supplied in the direction of arrow (3) produces turbulence as denoted by looped arrows 4*a* within the electrode 70. Due to the turbulence of the composite plating liquid 5, the SiC ceramic particles 32 can be distributed uniformly in the composite plating liquid 5 introduced in the cylindrical electrode 70.

The composite plating liquid 5 with the uniformly distributed SiC particles 32 passes through the through-holes 72 in the direction of arrow (4) and is then jetted out to the annular passage 8 in the direction of arrow (5). The jetted composite plating liquid 5 impinges on the inner surface of the hollow section 3 to again produce turbulence in the annular passage 8 as denoted by looped arrows. Owing to the turbulence, the SiC ceramic particles 32 can be distributed uniformly in the composite plating liquid 5 introduced in the annular passage 8.

Under such conditions, the power supply 7 of FIG. 1 is turned on to energize the cylindrical electrode 70 and cylinder block 2, so that Ni ions in the composite plating liquid 5 are deposited on the inner surface of the hollow section 3 and the SiC particles 32 are co-deposited in the Ni matrix 33. Because the SiC particles 32 are distributed practically uniformly in the composite plating liquid 5, the SiC particles 32 can also be co-deposited uniformly in the Ni matrix 33.

Figure 16:
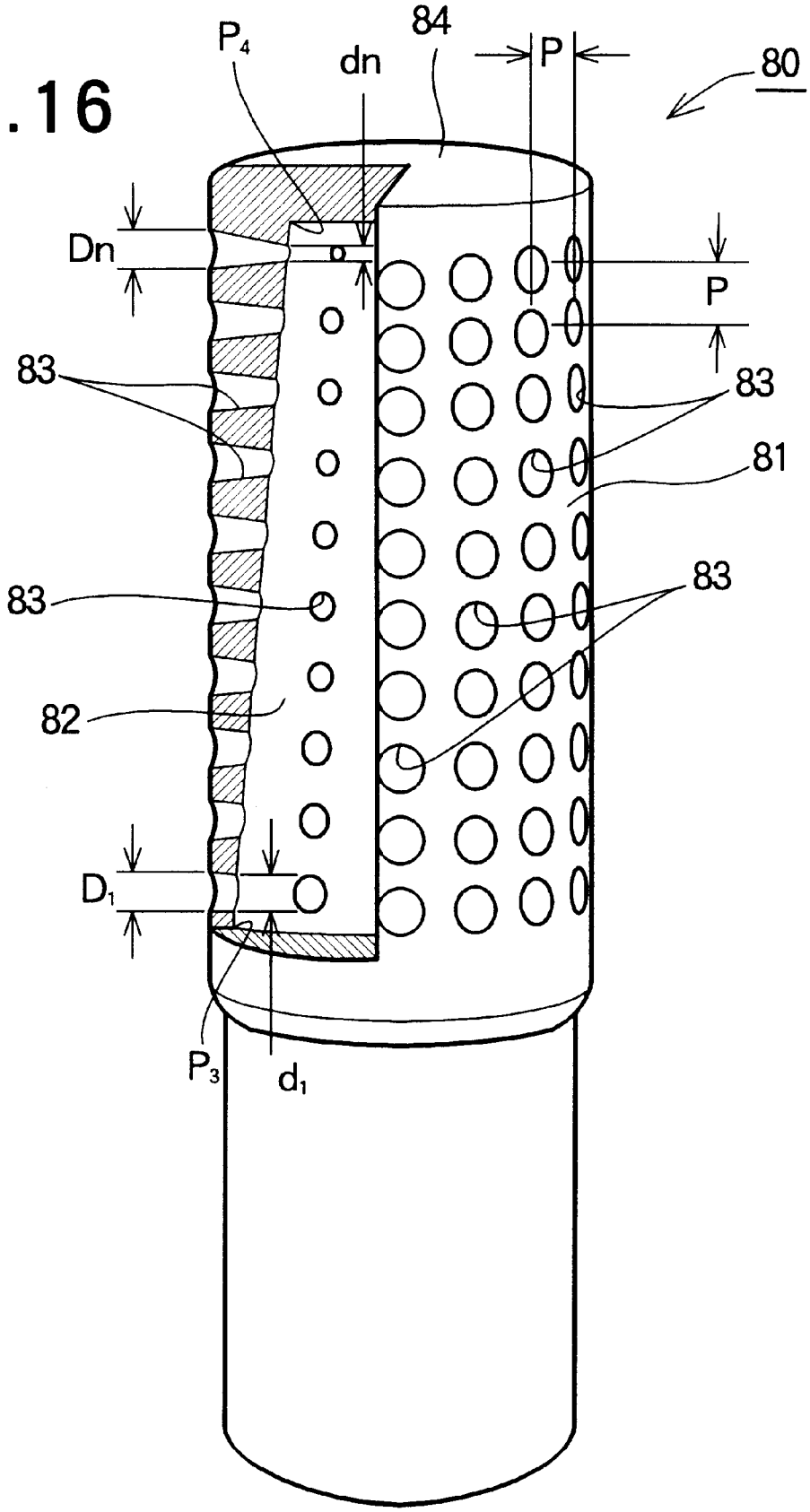
FIG. 16 is a perspective view, partly in section, of a sixth modification of the cylindrical electrode.

FIG. 16 is a perspective view, partly in section, of a sixth modification of the cylindrical electrode. Like the cylindrical electrode 60 described in relation to FIG. 11, this sixth modified cylindrical electrode 80 is characterized in that the outer wall 81 is formed to become progressively smaller in inner diameter in a direction from the upstream end or bottom $P_3$ to the downstream end or top $P_4$ so that the thickness of the outer wall 81 becomes gradually greater in the bottom-to-top direction of the electrode 80. Through-holes 83 are formed in the outer wall 81 at an equal pitch P in vertical and horizontal arrangements. Each of the through-holes 83 tapers, across the thickness of the wall 81, toward the interior of the electrode 80; that is, each of the through-holes 83 has a greatest diameter at the outer surface of the wall 81 and a smallest diameter at the inner surface of the wall 81. In addition, the smallest diameters $d_1$–$d_n$, at the inner surface of the wall 81, of the through-holes 83 are chosen to become progressively smaller as the through-holes 83 are located closer to the downstream end or top $P_4$ of the electrode 80, although the through-holes 83 have the same greatest diameter $D_1$–$D_n$ at the outer surface of the wall 81. The top of the cylindrical electrode 80 is covered and closed with the fixed lid portion 84.

Figure 17:
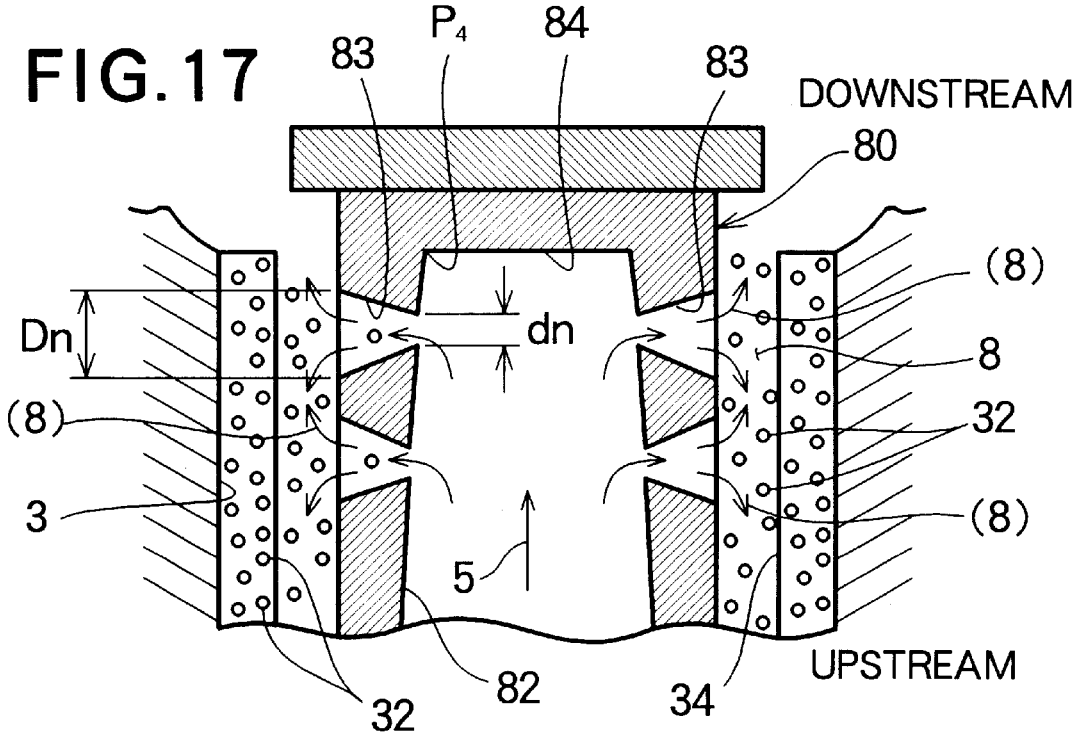
FIG. 17 is a partly-sectional view showing an overall flow of the composite plating liquid in the composite plating apparatus employing the sixth modified cylindrical electrode shown in FIG. 16.
Figure 18:
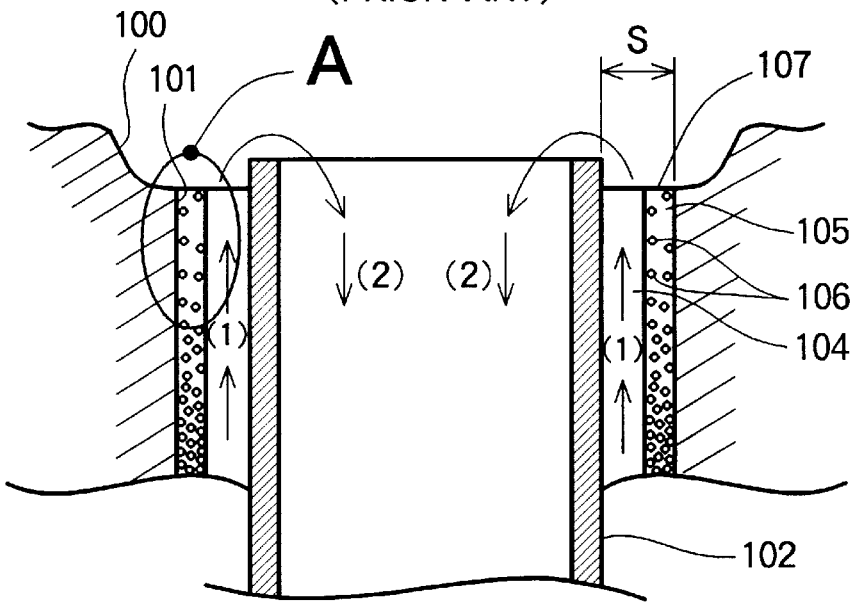
FIG. 18 (PRIOR ART)
FIG. 18 is a view explanatory of a Ni/SiC composite plating process performed by a conventional surface processing apparatus.
Figure 19:
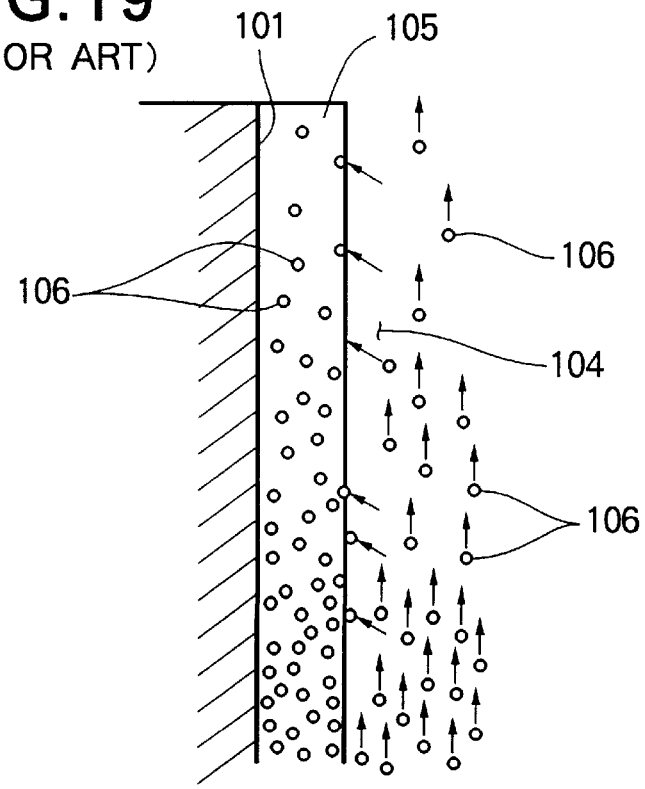
FIG. 19 (PRIOR ART)
FIG. 19 is a view showing, in enlarged scale, circled portion A of FIG. 18.

FIG. 17 is a fragmentary partly sectional view showing in greater detail the flow of the composite plating liquid 5 through the sixth modified cylindrical electrode 80 shown in FIG. 16. Namely, the composite plating liquid 5 supplied to the interior of the cylindrical electrode 80 and flowing downstream or upward as arrowed is blocked by the lid portion 84, so that the liquid pressure near the lid portion 84 would increase. However, because the smallest diameters $d_1$–$d_n$ at the inner surface of the wall 81, of the through-holes 83 become progressively smaller as the through-holes 83 are located closer to the downstream end or top $P_4$ of the electrode 80 as shown in FIG. 16, practically uniform amounts of the liquid 5 can be jetted out through the through-holes 83. Further, because the through-holes 83 have the same greatest diameter $D_1$–$D_n$ at the outer surface of the wall 81 as shown in FIG. 16, the liquid 5 can be jetted out through the through-holes 83 at equal intervals. Besides, the composite plating liquid 5 can be jetted out to the annular passage 8 while spreading in the direction of arrow (8). The spreading allows the composite plating liquid 5, jetted through the through-holes 83, to uniformly impinge on the inner surface of the hollow section 3 with high efficiency, so that the SiC ceramic particles 32 can be co-deposited in the Ni matrix in a uniformly distributed condition.

The essential feature of the composite plating apparatus employing any one of the fourth to sixth modified cylindrical electrodes is that the cylindrical electrode is closed at one end and designed to become progressively smaller or greater in inner diameter, in the flow direction of the liquid, with a plurality of through-holes formed in its outer wall. With this arrangement, the composite plating liquid introduced in the cylindrical electrode produces turbulence here and there within the electrode, so that the ceramic particles can be distributed uniformly in the liquid. As a result, the ceramic particles jetted through the through-holes can be co-deposited uniformly in the metallic matrix laminated on the inner surface of the hollow section, and hence the resultant composite plating film can have a uniform abrasion-resistant characteristic.

Whereas the cylindrical electrode in the preferred embodiment is shown as described as including, at its top, the barrier plate 12 smaller in diameter than the inner diameter of the hollow section 3, the diameter of the barrier plate 12 may be greater than the inner diameter of the hollow section 3 so that the annular passage 8 around the electrode is completely closed at its top to reliably prevent the composite plating liquid 5 from entering the crankcase 11.

Further, whereas the preferred embodiment has been described above as forming a composite plating film on a cylinder block of an internal combustion engine, the composite plating apparatus of the present invention can of course afford similar benefits when applied to other workpieces, than such a cylinder block 2, having hollow sections.

Furthermore, whereas Ni/Sic composite plating liquid 5 containing SiC particles 32 as ceramic particles is used in the described preferred embodiment, other ceramic particles than the SiC particles 32 may be contained in the liquid 5.

Moreover, whereas the preferred embodiment has been described above in relation to the case where the cylindrical electrode is covered with a lid portion only at its top, the electrode may be covered with a lid portion only at its bottom with the composite plating liquid supplied through its top.

In summary, the composite plating apparatus of the present invention arranged in the above-described manner allows ceramic particles, such as SiC particles, to be co-deposited uniformly in a resultant composite plating film, thereby achieving a uniform abrasion-resistant characteristic all over the plating film.

Obviously, various minor changes and modifications of the present invention are possible in the light of the above teaching. It is therefore to be understood that within the scope of the appended claims, the present invention may be practiced otherwise than as specifically described.

What is claimed is:

1. A composite plating apparatus for forming a composite plating film on an inner surface of a hollow section of a workpiece which comprises:

a cylindrical electrode adapted to be disposed in the hollow section of the workpiece with a surrounding gap left between a surface of an outer wall of said cylindrical electrode and the inner surface of the hollow section, said cylindrical electrode being closed at one of upper and lower ends thereof and having a plurality of through-holes formed across a thickness of the outer wall facing the inner surface of the hollow section;

a plating liquid circulating mechanism for supplying composite plating liquid, consisting of ceramic particles mixed in plating liquid, to an interior of said cylindrical electrode, for passing the composite plating liquid through the through-holes of said outer wall to be then jetted onto the inner surface of the hollow section, and for collecting the jetted composite plating liquid from a region surrounding said cylindrical electrode; and a power supply for energizing said workpiece and said cylindrical electrode.

2. A composite plating apparatus as recited in claim 1 wherein diameters of the through-holes are chosen to become progressively smaller as the through-holes are located closer to a downstream end of said cylindrical electrode.

3. A composite plating apparatus as recited in claim 1 wherein the through-holes are formed at a uniform pitch in the outer wall of said cylindrical electrode in such a manner as to provide vertical and horizontal arrangements of the through-holes.

4. A composite plating apparatus as recited in claim 1 wherein the through-holes are formed in the outer wall of said cylindrical electrode in such a manner as to provide vertical and horizontal arrangements of the through-holes, every adjacent ones of the arrangements forming a staggering or zigzag series of the through-holes.

5. A composite plating apparatus as recited in claim 1 wherein each of the through-holes tapers, across a thickness of the outer wall, toward an interior of said cylindrical electrode.

6. A composite plating apparatus as recited in claim 1 wherein said cylindrical electrode has an inner diameter that becomes progressively greater or smaller from an other end thereof to the closed one end.

7. A composite plating apparatus as recited in claim 6 wherein said through-holes are cylindrical holes of the same diameter.

8. A composite plating apparatus as recited in claim 6 wherein the through-holes are formed at a uniform pitch in the outer wall of said cylindrical electrode in such a manner as to provide vertical and horizontal arrangements of the through-holes.

9. A composite plating apparatus as recited in claim 6 wherein each of the through-holes tapers, across a thickness of the outer wall, toward an interior of said cylindrical electrode.

* * * * *